US009206610B2

(12) United States Patent
Wagner et al.

(10) Patent No.: US 9,206,610 B2
(45) Date of Patent: Dec. 8, 2015

(54) WALL PANEL, WALL PANEL KIT AND METHOD

(71) Applicant: Firestone Building Products Company, LLC, Indianapolis, IN (US)

(72) Inventors: Wayne M. Wagner, West St. Paul, MN (US); Robert T. Griffiths, Elk River, MN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 0 days.

(21) Appl. No.: 14/456,663

(22) Filed: Aug. 11, 2014

(65) Prior Publication Data

US 2014/0345108 A1 Nov. 27, 2014

Related U.S. Application Data

(62) Division of application No. 13/435,861, filed on Mar. 30, 2012, now Pat. No. 8,800,231.

(60) Provisional application No. 61/470,465, filed on Mar. 31, 2011.

(51) Int. Cl.

| | |
|---|---|
| ***E04F 13/08*** | (2006.01) |
| ***E04F 13/12*** | (2006.01) |
| ***E04F 13/18*** | (2006.01) |
| ***E04C 2/38*** | (2006.01) |

(52) U.S. Cl.

CPC ..... *E04F 13/0889* (2013.01); *E04C 2/38* (2013.01); *E04F 13/0801* (2013.01); *E04F 13/0837* (2013.01); *E04F 13/12* (2013.01); *E04F 13/18* (2013.01); *Y10T 29/49826* (2015.01)

(58) Field of Classification Search

CPC ..... E04C 2/38; E04F 13/12; E04F 13/18; E04F 13/0801; E04F 13/0889; E04F 13/0837

USPC ..... 52/537, 538, 545, 546, 588.1, 530, 542

See application file for complete search history.

(56) References Cited

U.S. PATENT DOCUMENTS

| | | | | | |
|---|---|---|---|---|---|
| 3,229,436 | A * | 1/1966 | Gerhart | E04F 13/0864 | 52/521 |
| 3,462,906 | A * | 8/1969 | Schroyer | E04D 3/363 | 52/478 |
| 3,969,866 | A * | 7/1976 | Kyne | F16B 5/0664 | 52/522 |
| 4,122,643 | A * | 10/1978 | Hafner | E04F 13/0864 | 52/520 |
| 5,187,911 | A * | 2/1993 | Cotter | E04D 3/366 | 52/469 |
| 5,393,176 | A * | 2/1995 | Waring | B23B 5/163 | 408/105 |
| 5,519,974 | A * | 5/1996 | Greenberg | E04D 3/363 | 52/518 |
| 5,980,156 | A * | 11/1999 | Morello | E21D 11/15 | 405/124 |
| 6,820,452 | B2 * | 11/2004 | Morello | B21D 13/04 | 72/196 |

* cited by examiner

*Primary Examiner* — Brian Glessner
*Assistant Examiner* — Adam Barlow
(74) *Attorney, Agent, or Firm* — Jason A. Houser; Fay Sharpe LLP

(57) ABSTRACT

A wall panel that can be secured along an associated wall structure is formed from a thin-walled material having a substantially uniform thickness. The wall panel includes first and second longitudinally-extending edges, and first, second and third wall portions. A first interengagement feature extends lengthwise along the first wall portion, and a second interengagement feature extends lengthwise along the second wall portion. The first and second interengagement features are dimensioned to cooperate with one another to operatively provide a non-visual indicator of a positive interengagement between two wall panels. A wall panel kit and a method of manufacture are also included.

7 Claims, 7 Drawing Sheets

WALL PANEL, WALL PANEL KIT AND METHOD

This application is a divisional of U.S. patent application Ser. No. 13/435,861, filed on Mar. 30, 2012.

This application claims priority from U.S. Provisional Patent Application No. 61/470,465, filed on Mar. 31, 2011, which is hereby incorporated herein by reference in its entirety.

BACKGROUND

The subject matter of the present disclosure broadly relates to the art of building materials and, more particularly, to a wall panel for securement on or along a wall structure as well as a wall panel kit and a method of forming a wall panel. The wall panel finds particular application when used in conjunction with at least one additional wall panel for forming an assembly, and will be described with particular reference thereto. However, it is to be appreciated that the subject matter of the present disclosure may also be amenable to use in connection with other applications.

Wall coverings of a wide variety of types, kinds and constructions are well known and commonly used as finishing elements that are secured to wall structures, such as, for example, to provide aesthetic appeal and/or to conceal undesirable features of a building structure that would otherwise remain exposed. In some cases, wall coverings may be installed along the exterior of a building structure. In addition to improving the aesthetic appearance of the building structure, such wall panels can also serve to cover elements of the building structure as an initial layer of protection from the exterior environment (i.e., weather conditions).

Wall panels are one type of wall covering that is widely used on building structures. Typically, wall panels are formed from thin-walled metal or plastic material, and can be roll-formed from elongated lengths of sheet material. In other cases, wall panels can be extruded into elongated lengths having the desired cross-sectional profile. Regardless of the material and/or method of manufacture, wall panels are generally dimensioned for and/or otherwise adapted for securement on or along generally flat surfaces, areas or regions of the wall structure of a building.

A conventional wall panel is typically used in combination with other wall panels to cover a portion of the wall structure. The wall panels are generally installed in an overlapping pattern and can, in such a manner, form an assembly on or along the wall structure of the building. In some cases, conventional wall panels are simply installed such that each panel at least partially overlaps at least one other panel. In other cases, however, the wall panels can include joint elements that extend lengthwise along opposing edges of the wall panels. Such joint elements are typically designed in a complimentary fashion such that at least a portion of a joint element along one wall panel will partially interengage a corresponding joint element of an adjacent wall panel. In this manner, adjacent wall panels can be operatively interconnected with one another.

During installation, conventional wall panels are positioned along and secured to the wall structure using suitable fasteners. As mentioned above, installation can also, optionally, include interconnecting a joint element of one wall panel with a corresponding joint element of an adjacent wall panel. In either case, the action of positioning a convention wall panel includes the installer determining that the wall panel has been properly aligned with the existing wall panels and, if included, determining that the joint elements have been properly interconnected.

It will be appreciated that the action of positioning conventional wall panels during installation on a wall structure is labor intensive and time consuming to do properly such that an aesthetically pleasing result is achieved. Additionally, achievement of an aesthetically pleasing installation can call for near-constant attention and diligent effort of the installers to ensure that each wall panel is properly aligned and/or interconnected with adjacent wall panels. Such attention to detail can increase the time needed to complete the installation process, which can result in increased costs and reduced productivity of the installation team.

Notwithstanding the wide usage and overall success of conventional wall panel designs, it is believed to be desirable to develop a wall panel construction, as well as a wall panel kit and a method of manufacturing, that avoids or minimizes the foregoing and/or other problems and/or disadvantages encountered in connection with conventional wall panel designs.

BRIEF DESCRIPTION

One example of a wall panel in accordance with the subject matter of the present disclosure that is securable along an associated wall structure can be formed from thin-walled material having a substantially uniform thickness. The wall panel can extend between a first end and a second end that is spaced longitudinally from the first end such that a wall panel length can be defined between the first and second ends. The wall panel can also include a first longitudinally-extending edge and a second longitudinally-extending edge that is spaced apart from the first edge such that a wall panel height can be defined between the first and second edges. The wall panel can include first, second and third wall portions that extend in a lengthwise direction along the wall panel between the first and second ends. The first wall portion can be disposed toward the first edge and the second wall portion can be disposed toward the second edge relative to the first wall portion. The third wall portion can be at least partially disposed between the first and second edges. The wall panel can further include a first interengagement feature extending lengthwise along the first wall portion, and a second interengagement feature extending lengthwise along the second wall portion. The wall panel can also include a first side adapted to face toward an associated wall structure and a second side that is disposed opposite the first side and is adapted to face away from the associated wall structure. The wall panel can further include a cross-sectional profile taken transverse to the lengthwise direction. The cross-sectional profile can include the first wall portion, which extends in a heightwise direction and at least partially defines a first plane. The cross-sectional profile can also include the second wall portion, which extends in approximately the heightwise direction and is in approximate alignment with the first plane. The cross-sectional profile can further include the third wall portion, which extends in the heightwise direction and is offset from the first and second wall portions. A wall panel depth can be at least partially defined between the third wall portion and the first and second wall portions. The third wall portion can at least partially define a second plane that is disposed in approximate alignment with the first plane. The first interengagement feature can be disposed along the first wall portion and can project outwardly from the first plane toward the second plane such that the first interengagement feature can be accessible from along the second side of the wall panel. The second interengagement feature can be disposed along the second wall portion and can be accessible from along the first side of the wall panel.

One example of a wall panel kit in accordance with the subject matter of the present disclosure that can be installed on an associated wall structure can include a first wall panel and a second wall panel that is dimensioned to operatively interengage the first wall panel. Each of the first and second wall panels can be formed from a thin-walled material having a substantially uniform thickness. The material can extend between a first end and a second end that is spaced longitudinally from the first end such that a wall panel length can be defined between the first and second ends. Each of the first and second wall panels can further include a first longitudinal edge and a second longitudinal edge that is spaced apart from the first edge such that a wall panel height can be defined between the first and second edges. First, second and third wall portions can extend in a lengthwise direction along the wall panel length between the first and second ends. The first wall portion can be disposed toward the first edge and the second wall portion can be disposed toward the second edge relative to the first wall portion. The third wall portion can be at least partially disposed between the first and second edges. A first side of the first and second wall panels can be adapted to face toward an associated wall structure and a second side of the first and second wall panels that is opposite the first side can be adapted to face away from the associated wall structure. The first and second wall panels can have a common cross-sectional profile taken transverse to the lengthwise direction. The cross-sectional profile can include the first wall portion, which extends in a heightwise direction and at least partially defines a first plane, and can include the second wall portion, which extends in approximately the heightwise direction and is in approximate alignment with the first plane. The cross-sectional profile can also include the third wall portion, which extends in the heightwise direction and is offset from the first and second wall portions such that a wall panel depth is at least partially defined between the third wall portion and the first and second wall portions. The third wall portion can at least partially define a second plane disposed in approximate alignment with the first plane. The first wall panel can also include a first interengagement feature that extends lengthwise along the first wall portion and projects outwardly from the first plane toward the second plane such that the first interengagement feature is accessible from along the second side of the first wall panel. The second wall panel can include a second interengagement feature that extends lengthwise along the second wall portion and can be accessible from along the first side of the second wall panel. The second interengagement feature can be cooperable with the first interengagement feature such that the first and second interengagement features operatively provide a non-visual indicator of a positive interengagement between the first wall panel and the second wall panel.

One example of a method of forming a wall panel in accordance with the subject matter of the present disclosure that is dimensioned for securement on a wall structure can include receiving a quantity of thin-walled material having an elongated length. The method can also include forming a wall panel strip from the quantity of thin-walled material. The wall panel strip can include a first longitudinal edge and a second longitudinal edge that is spaced apart from the first edge such that wall panel height can be defined between the first and second edges. The method can further include forming first, second and third wall portions extending in a lengthwise direction along the elongated length of the wall panel strip. The first wall portion can be disposed toward the first edge and the second wall portion can be disposed toward the second edge relative to the first wall portion. The third wall portion can be at least partially disposed between the first and second edges. The method can also include forming at least the first, second and third wall portions into a cross-sectional profile taken transverse to the lengthwise direction. The cross-sectional profile can include the first wall portion at least partially defining a first plane that extends in a heightwise direction, the second wall portion extending in approximate alignment with the first plane, and the third wall portion at least partially defining a second plane disposed in approximate alignment with the first plane. The third wall portion can extend in the heightwise direction and can be offset from the first and second wall portions such that a wall panel depth is at least partially defined between the third wall portion and the first and second wall portions. The method can further include forming a first interengagement feature that extends lengthwise along the first wall portion and projects outwardly from the first plane toward the second plane such that the first interengagement feature can be accessible from along one side of the wall panel strip. The method can also include forming a second interengagement feature that extends lengthwise along the second wall portion such that the second interengagement feature can be accessible from along an opposing side of the wall panel strip.

DETAILED DESCRIPTION

Turning now to the drawings, it is to be understood that the showings are for purposes of illustrating exemplary embodiments only and are not intended to be limiting. Additionally, it will be appreciated that the drawings are not to scale and that portions of certain elements may be exaggerated for purpose of clarity and ease of illustration.

Figure 1:
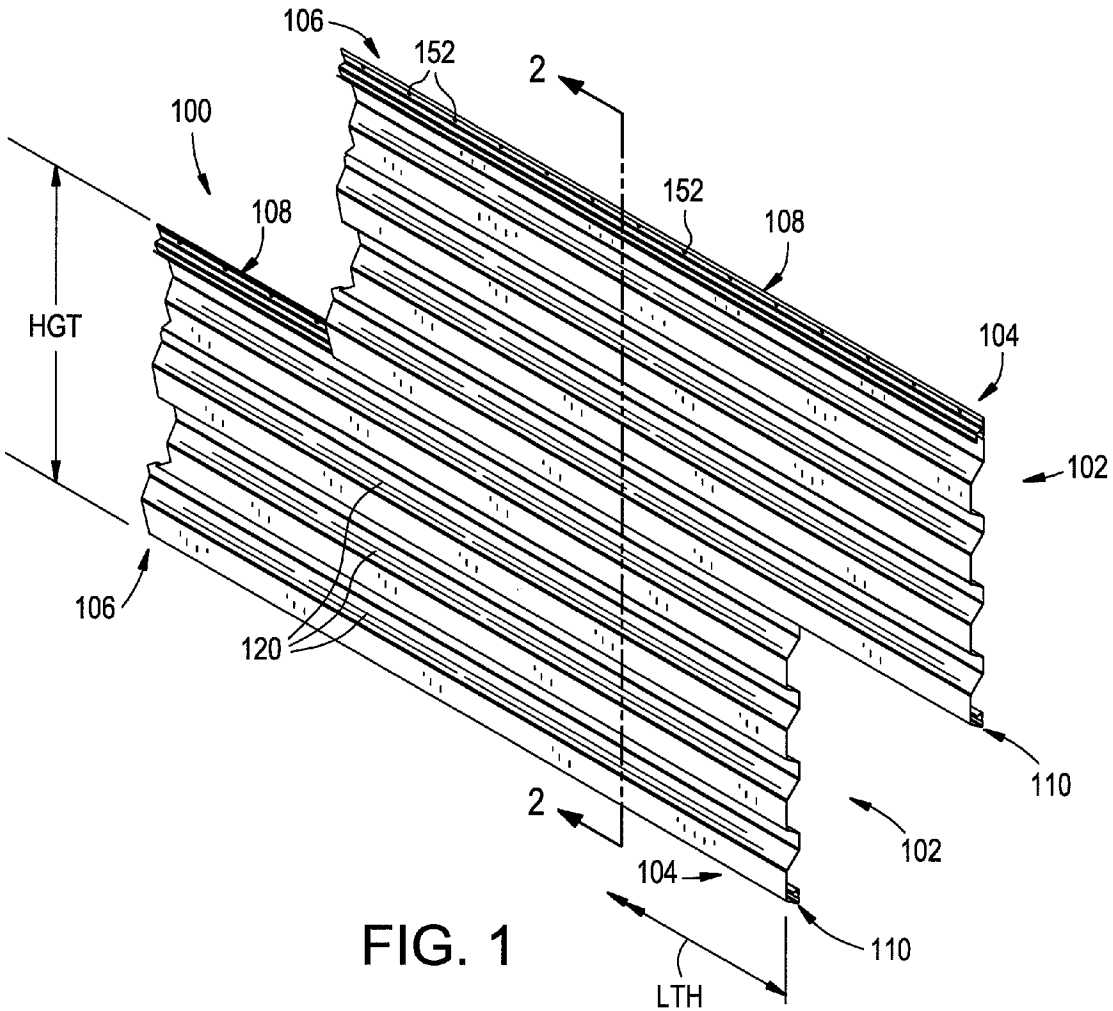
FIG. 1 is a perspective view of one example of a wall panel assembly that includes two wall panels in accordance with the subject matter of the present disclosure.
Figure 2:
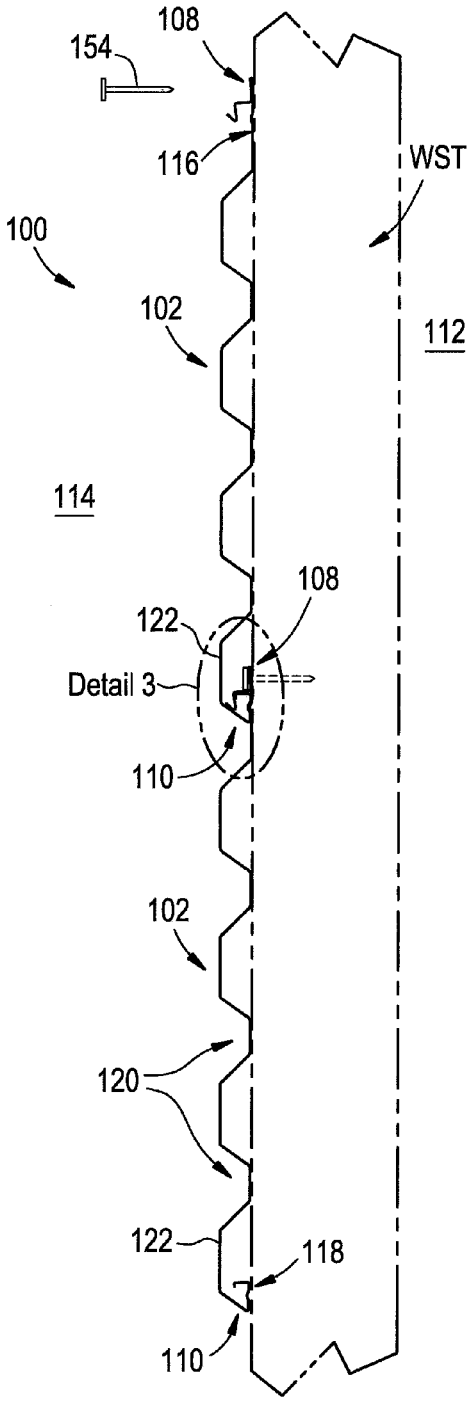
FIG. 2 is a cross-sectional side view of the exemplary wall panels of FIG. 1 shown assembled on an associated wall structure with the section taken from along line 2-2 in FIG. 1.

The subject matter of the present disclosure broadly relates to wall panels that are dimensioned or otherwise adapted for securement on or along an associated wall structure, such as an exterior wall structure of a building, for example. The wall panels are adapted to operatively interengage one another such that a corresponding wall panel assembly can be formed by a plurality of wall panels. With reference to FIGS. 1 and 2, one example of a wall panel assembly 100 is shown installed on an associated wall structure WST (FIG. 2), such as an exterior wall of a building, for example.

It will be appreciated that a wall panel assembly, such as wall panel assembly 100, for example, can include any suitable number of two or more individual wall panels and that the individual wall panels can be of any suitable configuration and/or aesthetic design. In some cases, a combination of wall panels having different configurations and/or aesthetic designs may be used. In the exemplary arrangement shown in FIGS. 1 and 2, wall panel assembly 100 includes a plurality of wall panels 102 having a common configuration and aesthetic design.

Additionally, it will be appreciated that wall panels in accordance with the subject matter of the present disclosure, such as wall panels 102, for example, can be formed or otherwise provided in any suitable size, shape, arrangement and/or configuration, and that no limitations are made herein with regard to the dimensions of such wall panels. Furthermore, it will be appreciated that wall panels in accordance with the subject matter of the present disclosure, such as wall panels 102, for example, will include a cross-sectional profile that can provide an aesthetic design to at least a portion of each wall panel, and that such cross-sectional profiles can include any suitable combination of wall profile shapes, such as substantially linear wall segments, curvilinear wall segments and/or angled wall segments, for example.

Further still, it will be appreciated that wall panels in accordance with the subject matter of the present disclosure, such as wall panels 102, for example, are typically formed from a thin-walled material having a substantially uniform thickness. The thin-walled material can be a generally rigid or semi-rigid material, such as, for example, a metal (e.g., aluminum), a polymeric material (e.g., polyvinyl chloride) or a composite material that includes a combination of materials (e.g., metal and polymeric material). As such, it will be appreciated that a wide variety of materials can be used and that the subject matter of the present disclosure is not intended to be limited to a particular material or combination of materials.

Though shown as being of an indefinite length in FIG. 1, wall panels 102 are illustrated as extending between a first end 104 and a second end 106 that is spaced longitudinally from the first end such that a wall panel length, which is represented in FIG. 1 by reference dimension LTH, is at least partially defined between first and second ends 104 and 106. Wall panels 102 further include a first longitudinally-extending edge 108 and a second longitudinally-extending edge 110 that is spaced apart from the first edge such that a wall panel height, which is represented in FIG. 1 by reference dimension HGT, is at least partially defined between first and second edges 108 and 110. No limitations are made herein with regard to wall panel length LTH relative to wall panel height HGT. As such, the distance between first and second edges 108 and 110 can be longer or shorter than the distance between first and second ends 104 and 106, thus providing wall panels 102 of various areas, sizes and shapes.

Figure 3:
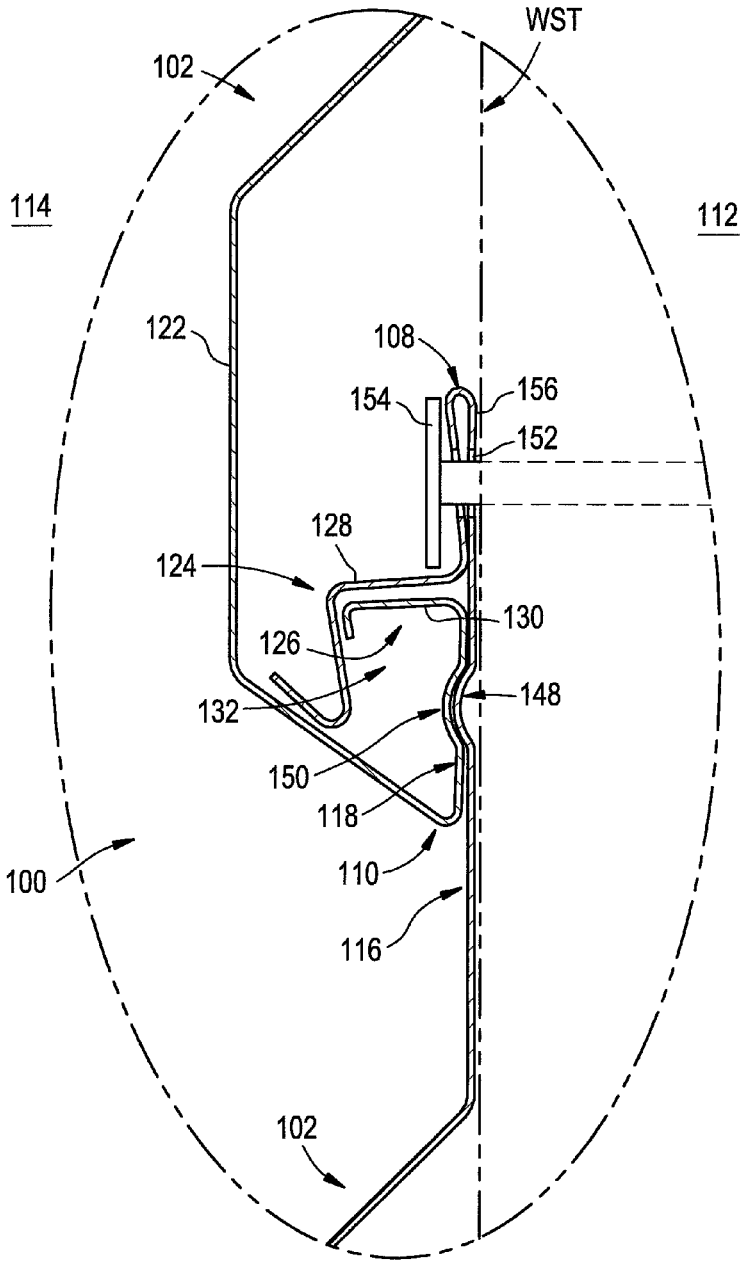
FIG. 3 is an enlarged view of the portion of the exemplary wall panels in FIGS. 1 and 2 identified in Detail 3 of FIG. 2 and illustrating exemplary interengagement features.
Figure 4:
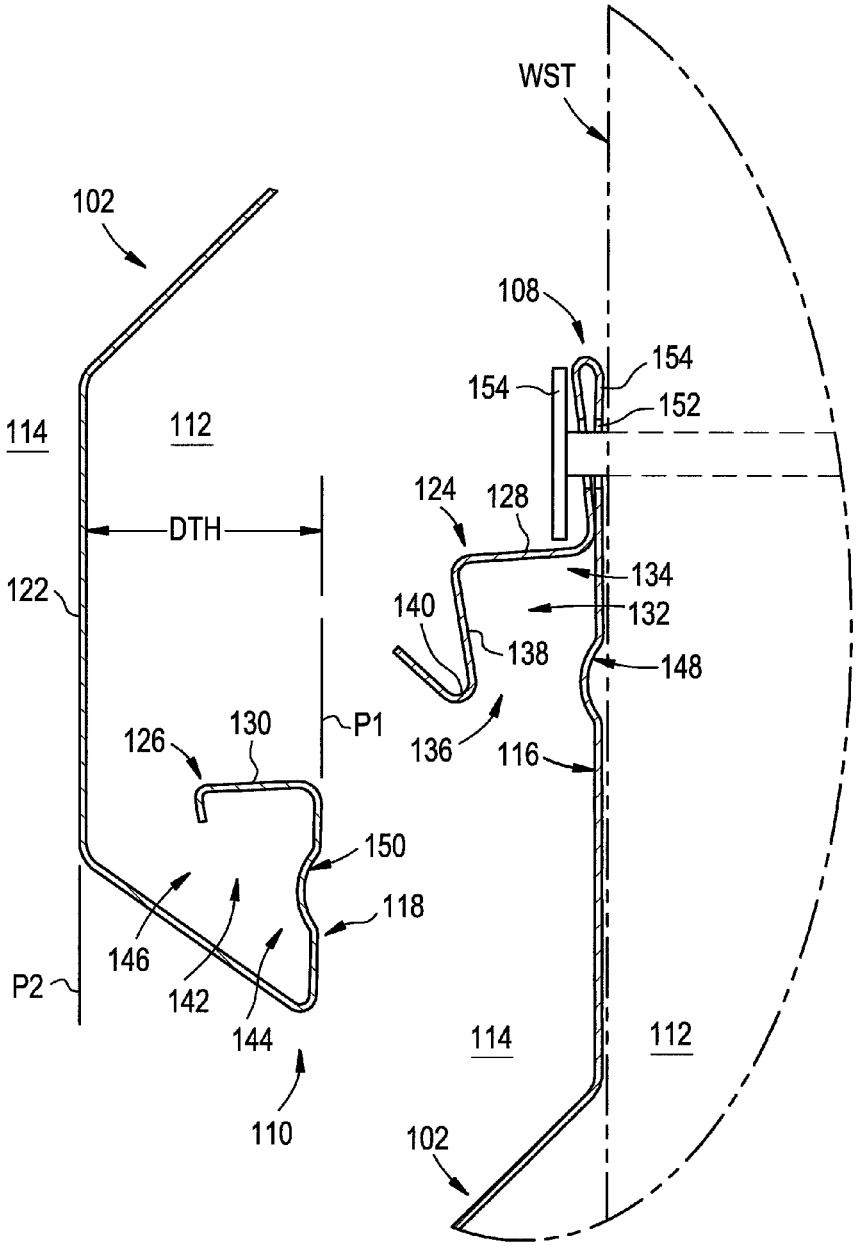
FIG. 4 is an exploded view of the interengagement features shown in FIG. 3.

As identified in FIGS. 2-4, wall panel 102 has a first side 112 that is dimensioned for or otherwise adapted to face toward wall structure WST, and a second side 114 that is disposed opposite first side 112 and adapted to face away from the associated wall structure. As indicated above, wall panel 102 can include a cross-sectional profile of any suitable configuration and/or arrangement, particularly along any aesthetic portions of the wall panel. The cross-sectional profile is taken transverse to the lengthwise direction of wall panels 102.

A wall panel in accordance with the subject matter of the present disclosure, such as wall panel 102, for example, can include a first wall portion 116 that extends in a lengthwise direction along the wall panel between first and second ends 104 and 106. First wall portion 116 is identified in FIGS. 2-4 as being disposed toward first edge 108. Wall panel 102 can further include a second wall portion 118 that also extends in a lengthwise direction along the wall panel between first and second ends 104 and 106. Second wall portion 118 is identified in FIGS. 2-4 as being disposed toward second edge 110 relative to first wall portion 116.

It will be recognized that first and second wall portions 116 and 118 correspond to wall segments of the cross-sectional profile of the wall panel. For example, first wall portion 116 is shown in FIGS. 2-4 extending in a heightwise direction and at least partially defines a first plane P1 (FIG. 4) of the wall panel. Second wall portion 118 also extends in approximately the heightwise direction and is disposed in approximate alignment with first plane P1. In this manner, first and second wall portions 116 and 118 can extend in an approximately common plane (e.g., first plane P1) and in approximate alignment with one another in a generally heightwise direction.

As discussed above, wall panels in accordance with the subject matter of the present disclosure can include one or more features and/or elements, such as one or more additional wall portions, for example, that contribute to the aesthetic appearance of the wall panels. It will be appreciated that such one or more additional wall portions can be of any suitable size, shape, form and/or arrangement, such as has been described above. In the illustrated embodiment shown in FIGS. 1-4, wall panel 102 includes a plurality of additional wall portions that are configured to form a plurality of corrugations or channels 120 that extend lengthwise along the wall panel. For purposes of clarity and easy of understanding, one of these additional wall portions is identified in FIGS. 2-4 and described herein as a third wall portion 122.

Additionally, it will be recognized that third wall portion 122 and any additional wall portions, such as those that contribute to the aesthetic appearance of the wall panel, will also correspond to wall segments of the cross-sectional profile of the wall panel. For example, third wall portion 122 extends in the heightwise direction and is offset from first and second wall portions 116 and 118 in a direction toward second side 114. In this manner, a wall panel depth can be at least partially defined between third wall portion 122 and first and second wall portions 116 and 118, as is represented in FIG. 4 by reference dimension DTH.

Third wall portion 122 can at least partially define a second plane P2 (FIG. 4) disposed in approximate alignment with first plane P1. In one embodiment, the third wall portion 122 can extend along a substantial portion of wall panel height HGT, which is at least partially defined between first and second edges 108 and 110, as discussed above. In the illustrated embodiment, third wall portion 122 is disposed toward second edge 110 and a plurality of additional wall portions are spaced apart from one another in the heightwise direction such that multiple corrugations 120 extend lengthwise along the wall panel. In one exemplary embodiment, corrugations 120 of wall panel 102 can be evenly spaced along the wall panel height.

Additionally, FIGS. 1 and 2 show corrugations 120 as being defined by additional wall portions that either extend inwardly toward first plane P1 or lie in approximate alignment with first plane P1. As another example, the corrugations could include a depth that is defined by wall portions that lie in a third plane (not shown) that is offset from the first and second planes but oriented in approximate alignment therewith.

As discussed above, wall panels in accordance with the subject matter of the present disclosure can be adapted to operatively interengage one another. In the exemplary arrangements shown in FIGS. 1-4, wall panel 102 is adapted to connect to or otherwise operatively interengage an adjacent wall panel to form wall panel assembly 100. FIGS. 2 and 3 illustrate two wall panels 102 that are operatively interengaged with one another by way of complimentary first and second joint elements 124 and 126 that extend lengthwise along wall panels 102 adjacent first and second edges 108 and 110, respectively.

FIG. 3 illustrates first and second joint elements 124 and 126 operatively interconnected such that the first and second wall panels are connected to one another and form wall panel assembly 100. FIG. 4 illustrates the wall panels prior to assembly with first and second joint elements 124 and 126 operatively disengaged. The interengagement of the first and second joint elements is more particularly achieved by way of complimentary joint walls. As one example, first joint element 124 can include a first joint wall 128 disposed along second side 114 of wall panel 102. First joint wall 128 projects outwardly from first wall portion 116 and can extend generally transverse thereto. Second joint element 126 can also include a second joint wall 130 that is disposed along second side 114 of a wall panel. However, second joint wall 130 projects outwardly from second wall portion 118. Accordingly, second joint wall 130 is dimensioned to compliment first joint wall 128.

Additionally, first wall portion 116 in combination with first joint wall 128 at least partially defines a first recess 132 that extends lengthwise along the wall panel and includes a closed end 134 that is disposed toward first edge 108 and an open end 136 that is disposed toward second edge 110. One embodiment of first joint element 124, for example, can optionally include additional joint wall portions 138 and 140 that further define first recess 132.

In the illustrated example, second wall portion 118 together with second joint wall 130 at least partially defines a second recess 142 that extends lengthwise along the wall panel and includes a closed end 144 and an open end 146 disposed toward third wall portion 122.

Wall panel 102 also includes interengagement features 148 and 150 that can function to provide a non-visual indication that adjacent wall panels, such as wall panels 102, for example, are properly interengaged with one another such that the wall panels can be secured to an associated wall structure. In this manner, an installer may be able to secure a series of wall panels, such as wall panels 102, for example, to the associated wall structure without having to inspect the alignment after each wall panel is installed. Interengagement features 148 and 150 can provide a tactile or other non-visual indication, such as when a first interengagement feature 148 engages a second interengagement feature 150 on an adjacent wall panel. In some cases, this non-visual indication may also include an audible click or other noise when the first and second interengagement features engage.

Figure 5:
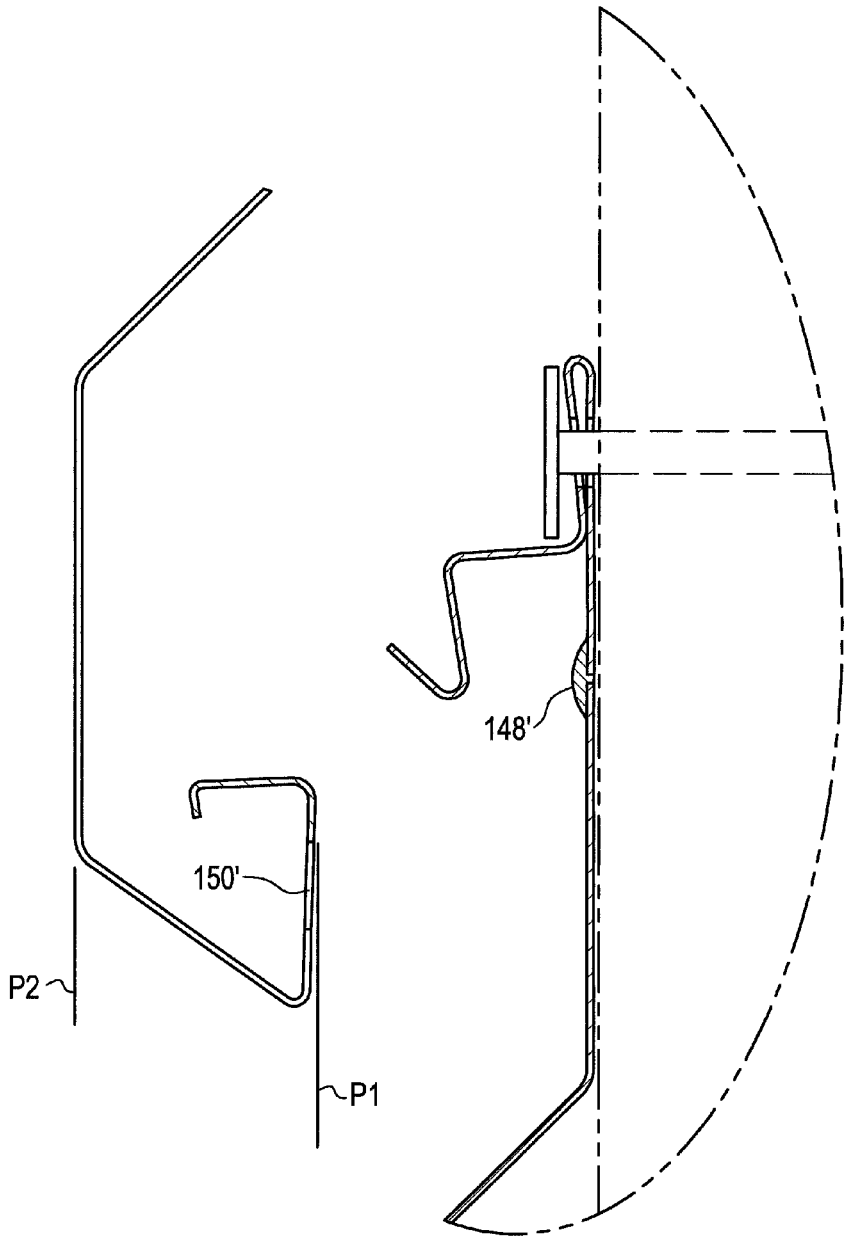
FIG. 5 is an exploded view of an alternate embodiment of the interengagement features shown in FIGS. 3 and 4.

Interengagement features 148 and 150 can be formed on or along the wall panels in any suitable manner. As one example, interengagement features 148 and 150 are shown as being integrally formed from the thin-walled material of the wall panels. Alternately, either or both of the interengagement features can be separately formed or otherwise provided on or along the wall panel. For example, an alternate arrangement is shown in FIG. 5 in which a first interengagement feature 148' is formed from a separate material, such as a polymeric material, for example, that is molded onto or otherwise provided along the wall panel. Additionally, second interengagement feature 150' can be formed as a plurality of openings or slots that are spaced apart from one another in a lengthwise direction along the wall panel.

First interengagement feature 148 is disposed along first wall portion 116 and projects outwardly from first plane P1 toward second plane P2 such that first interengagement feature 148 is accessible from along second side 114 of wall panel 102. In one embodiment, first interengagement feature 148 includes a substantially continuous rib that extends in the lengthwise direction. In another embodiment, the first interengaging feature can be discontinuous, such as by including a plurality of first interengagement features disposed in lengthwise spaced relation to one another. In such case, the first interengagement feature can include a plurality of interengagement elements that are spaced apart from one another in the lengthwise direction. Furthermore, a combination of various types of first interengagement features can be used, such as, for example, a combination of different interengagement elements.

Second interengagement feature 150 extends lengthwise along second wall portion 118 and recesses inwardly from first plane P1 toward second plane P2 such that second interengagement feature 150 is accessible from along first side 112 of the wall panel. In one embodiment, the second interengagement feature can include a substantially continuous channel that extends in the lengthwise direction.

As mentioned above, during installation of one wall panel on or along an adjacent wall panel, corresponding interengagement features are concealed from view from along second side 114. Additionally, conventional installation can include connecting a first wall panel to the associated wall structure and then securing a second wall panel to the associated wall structure with at least a partial overlap of the first wall panel. Accordingly, wall panels 102 can, optionally, include one or more features for securement of the wall panel to the associated wall structure. In one example, a plurality of holes 152 can be provided that are dimensioned to receive associated fasteners 154. Holes 152 can be disposed in spaced-apart relation to one another in the lengthwise direction of the wall panel, such as is illustrated in FIG. 1, for example. In one embodiment, as shown in FIGS. 2 and 4, holes 152 can be positioned adjacent to first edge 108 of the wall panel. In this manner, holes 152 remain exposed during the installation process. Accordingly, an installer is able to visually identify the holes during installation.

In one embodiment, wall panel 102 is formed from one continuous sheet of the thin-walled material. Accordingly, wall panel 102 can include a fastening wall portion 156 adjacent first edge 108 through which holes 152 can be formed. In some cases, the sheet material from which wall panel 102 is formed can be folded over on itself to such that holes 152 extend through two layers of thin-walled material, such as is shown in FIGS. 3-5, for example.

As mentioned above, one feature of interengagement features 148 and 150 is that the same are concealed from view when the wall panels are secured to the associated wall structure. In this manner, the aesthetic quality of the wall panels is not diminished due to exposed components.

Figure 6A:
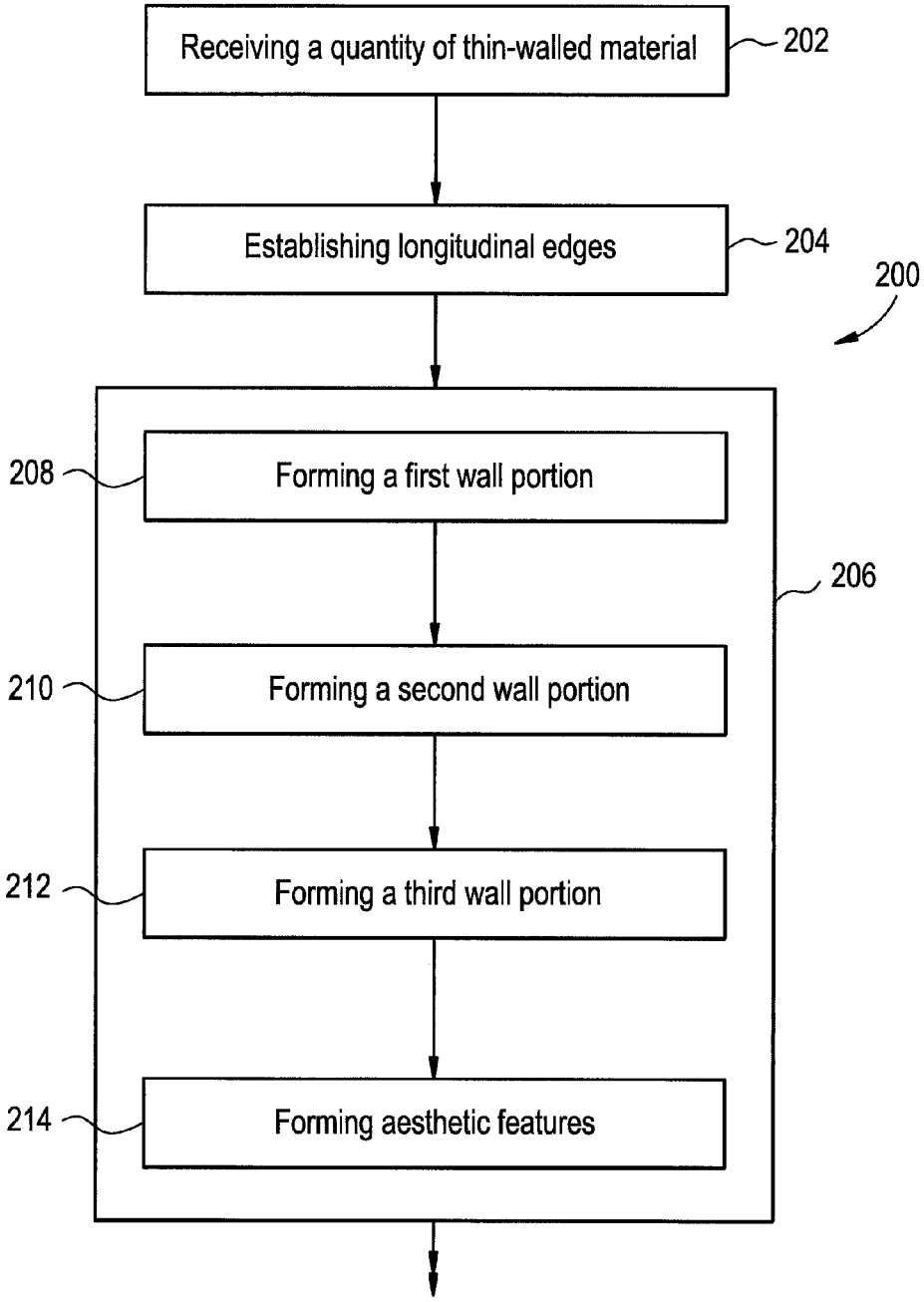
FIGS. 6A and 6B graphically represent one example of a method of forming a wall panel in accordance with the subject matter of the present disclosure.

One example of a method 200 of forming a wall panel in accordance with the subject matter of the present disclosure that is dimensioned for securement on an associated wall structure is now described in connection with FIGS. 6A and 6B. Method 200 can include receiving a quantity of thin-walled material having an elongated length, such as is represented in FIG. 6A by item number 202. It will be appreciated that the length, width and/or other specifications of the thin-walled material can be based at least in part on the desired size, shape and/or configuration of a completed wall panel. As such, no limitations are made herein with regard to such length, width and/or other specifications. In some cases, the quantity of material can take the form of an elongated strip having a discrete length and extending lengthwise between a first end and a second end spaced apart from the first end. In other cases, the quantity of material can be received in the form of a coil of material having an indeterminate length.

Method 200 can also include forming or otherwise establishing a first longitudinal edge and a second longitudinal edge that is spaced apart from the first edge such that a wall panel height HGT can be established or otherwise defined, such as is represented in FIG. 6A by item number 204. Method 200 can further include forming a cross-sectional profile on or along the quantity of material, such as is represented in FIG. 6A by item number 206. In some cases, the cross-sectional profile can be taken transverse to the lengthwise direction of the quantity of material.

The cross-sectional profile can be defined in any suitable manner and can include any number of one or more cross-sectional wall portions in any desired pattern, configuration and/or arrangement. In some cases, action 206 of forming a cross-sectional profile can include forming a first wall portion along the quantity of material, such as is represented in FIG. 6A by item number 208. In some cases, such a first wall portion can be formed toward the first edge and extend lengthwise along the quantity of material. In some cases, such a first wall portion can at least partially defining a first plane oriented in a heightwise direction. In some cases, action 206 of forming a cross-sectional profile can include forming a second wall portion along the quantity of material, such as is represented in FIG. 6A by item number 210. In some cases, such a second wall portion can be formed toward the second edge and extend lengthwise along the quantity of material. In some cases, such a second wall portion can be disposed within the first plane that is at least partially defined by the first wall portion.

Additionally, action 206 of forming a cross-sectional profile can include forming a third wall portion along the quantity of material, such as is represented in FIG. 6A by item number 212. In some cases, such a third wall portion can be formed between the first and second edges and can extend lengthwise along the quantity of material. In some cases, such a third wall portion can at least partially define a second plane that is in approximate offset alignment with the first plane such that a wall panel depth can be at least partially defined between the third wall portion and the first and second wall portions. In some cases, action 206 can, optionally, include forming one or more aesthetic features on or along the third wall portion, such as is represented in FIG. 6A by item number 214. In some cases, the one or more aesthetic features can include one or more fourth wall portions that are displaced in a depthwise direction relative to the third wall portion. As one example, such one or more aesthetic features can include a plurality of corrugations that extend lengthwise along the quantity of material.

Method 200 can also include forming at least one joint element along each of the first and second longitudinal edges of the quantity of material. In some cases, method 200 can include forming a first joint element, such as joint element 124, for example, along the first longitudinal edge, such as is represented in FIG. 6B by item number 216. In some cases, action 216 of forming a first joint element can include forming a first joint wall (e.g., joint wall 128) extending lengthwise along the quantity of material, such as is represented in FIG. 6B by item number 218, and shaping the first joint wall into the first joint element, such as is represented by item number 220. Method 200 can also include forming a first interengaging feature, such as interengaging feature 148, for example, along the first wall portion adjacent the first joint element, such as is represented in FIG. 6B by item number 222.

Figure 6B:
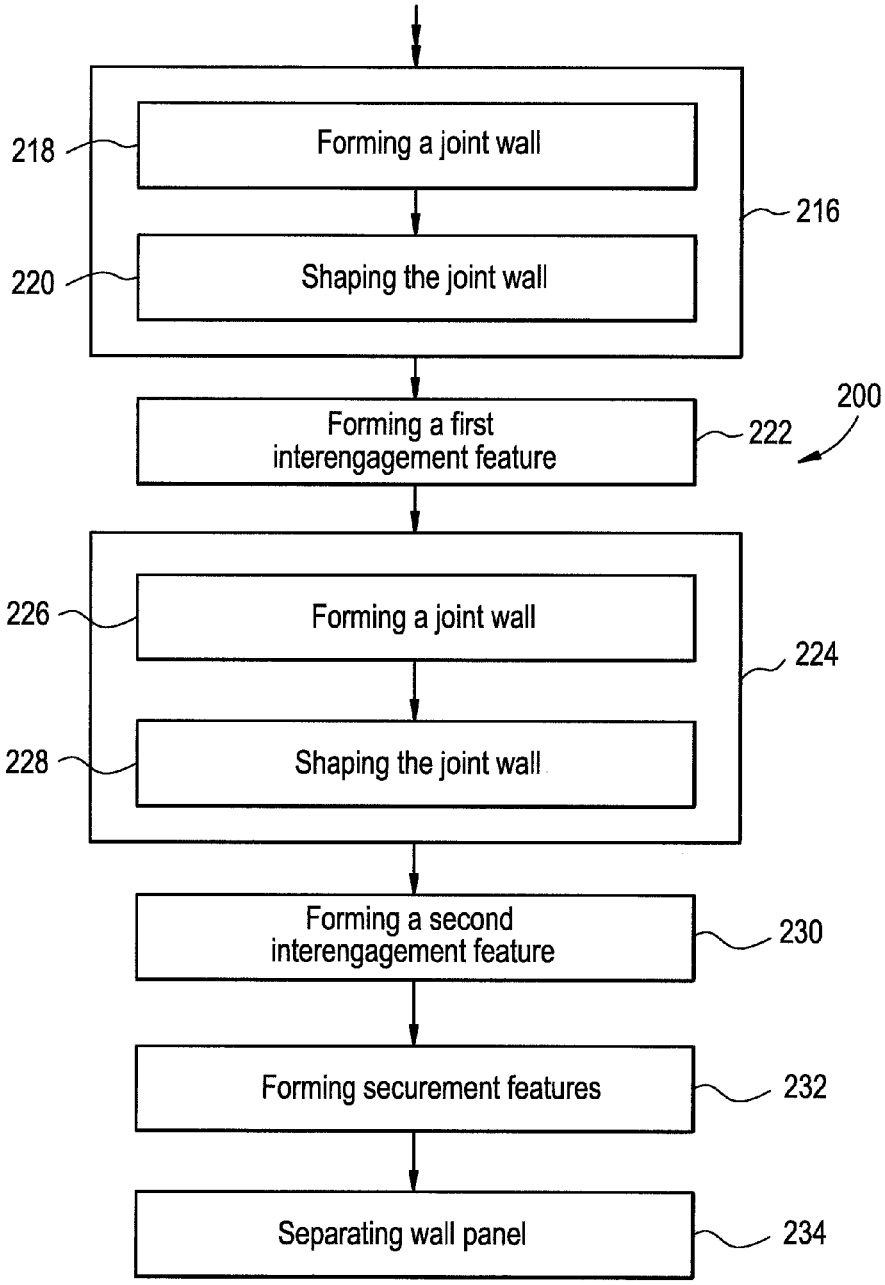

Method 200 can further include forming a second joint element, such as joint element 126, for example, along the second longitudinal edge, such as is represented in FIG. 6B by item number 224. In some cases, action 224 of forming a second joint element can include forming a second joint wall (e.g., joint wall 130) extending lengthwise along the quantity of material, such as is represented in FIG. 6B by item number 226, and shaping the second joint wall into the second joint element, such as is represented by item number 228. Method 200 can also include forming a second interengaging feature, such as interengaging feature 150, for example, along the second wall portion adjacent the second joint element, such as is represented in FIG. 6B by item number 230.

Method 200 can further include an optional action of forming one or more securement features on or along the quantity of material, such as is represented in FIG. 6B by item number 232. It will be appreciated that, if provided, securement features of any suitable size, shape and/or configuration could be used. As one example, a plurality of holes 152 is shown as being formed along first longitudinal edge 108. Method 200 can also, optionally, include an action of shearing, cutting, severing or otherwise separating a formed wall panel from the quantity of material, such as is represented in FIG. 6B by item number 234.

Although method 200 is illustrated and described above in the form of a series of actions or events, it will be appreciated that the various methods or processes of the present disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The disclosure is not limited to the specific applications and embodiments illustrated and described herein.

As used herein with reference to certain features, elements, components and/or structures, numerical ordinals (e.g., first, second, third, fourth, etc.) may be used to denote different singles of a plurality or otherwise identify certain features, elements, components and/or structures, and do not imply any order or sequence unless specifically defined by the claim language.

It will be recognized that numerous different features and/or components are presented in the embodiments shown and described herein, and that no one embodiment may be specifically shown and described as including all such features and components. As such, it is to be understood that the subject matter of the present disclosure is intended to encompass any and all combinations of the different features and components that are shown and described herein, and, without limitation, that any suitable arrangement of features and components, in any combination, can be used. Thus it is to be distinctly understood claims directed to any such combination of features and/or components, whether or not specifically embodied herein, are intended to find support in the present disclosure.

Thus, while the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles hereof. Obviously, modifications and alterations will occur to others upon reading and understanding the preceding detailed description. Accordingly, it is to be distinctly understood that the foregoing descriptive matter is to be interpreted merely as illustrative of the subject matter of the present disclosure and not as a limitation. As such, it is intended that the subject matter of the present disclosure be construed as including all such modifications and alterations.

The invention claimed is:

1. A method of manufacturing a wall panel securable on an associated wall structure, said method comprising:

providing a quantity of thin-walled material having a substantially uniform thickness;

forming a first end and a second end spaced longitudinally from said first end along at least a portion of said thin-walled material to at least partially define a wall panel section with a wall panel length defined between said first and second ends, said wall panel section having a first side adapted to face toward the associated wall structure, a second side opposite said first side and adapted to face away from the associated wall structure;

forming a first longitudinally-extending edge and a second longitudinally-extending edge spaced apart from said first edge along said wall panel section such that a wall panel height is defined between said first and second edges;

forming a first wall portion extending in a lengthwise direction along said wall panel section between said first and second ends, said first wall portion being disposed toward said first edge, and said first wall portion extending in a heightwise direction and at least partially defining a first plane;

forming a second wall portion extending in a lengthwise direction along said wall panel section between said first and second ends, said second wall portion being disposed toward said second edge relative to said first wall portion, said second wall portion extending in approximately said heightwise direction and in approximate alignment with said first plane;

forming a third wall portion wall portion extending in a lengthwise direction along said wall panel section between said first and second ends, said third wall portion being at least partially disposed between said first and second edges, said third wall portion extending in said heightwise direction and offset from said first and second wall portions such that a wall panel depth is at least partially defined between said third wall portion and said first and second wall portions, said third wall portion at least partially defining a second plane disposed spaced apart from and oriented in approximate alignment with said first plane, said third wall portion being coextensive with at least a portion of said second wall portion;

forming a fourth wall portion extending in a lengthwise direction along said wall panel section between said first and second ends, said fourth wall portion operatively connecting said second and third wall portions to one another;

forming a first interengagement feature along said wall panel section, said first interengagement feature extending lengthwise along said first wall portion;

forming a second interengagement feature along said wall panel section, said second interengagement feature extending lengthwise along said second wall portion such that said third and fourth wall portions at least partially conceal said second interengagement feature when viewed from along said second side;

forming a first joint element along said wall panel section, said first joint element extending lengthwise along said wall panel section adjacent said first edge, said first joint element including a first joint wall disposed along said second side of said wall panel section and a recess extending lengthwise along said wall panel section having a closed end and an open end with said closed end having a greater dimension measured in the direction of said wall panel depth than said open end; and, forming a second joint element along said wall panel section, said second joint element extending lengthwise along said wall panel section adjacent said second edge, said second joint element including a second joint wall disposed along said second side of said wall panel section and having a complimentary shape to at least a portion of said recess with said second joint wall having a dimension approximately the same as said closed end of said recess.

2. A method according to claim 1, wherein forming said first and second joint elements includes forming complementary first and second joint elements such that one of said first and second joint elements can receivingly interengage the other of said first and second joint elements.

3. A method according to claim 1, wherein forming said first and second joint elements includes forming at least one of said first and second joint elements extending lengthwise along said wall panel section substantially continuously between said first and second ends.

4. A method according to claim 1, wherein forming said first and second joint elements includes forming at least one of said first and second joint elements integrally with said first and second wall portions from said thin-walled material.

5. A method according to claim 1, wherein forming said first and second interengagement features includes forming at least one of said first and second interengagement features as one of a substantially continuous rib and a substantially continuous channel extending in said lengthwise direction from about said first end to about said second end.

6. A method according to claim 1, wherein forming said first and second interengagement features includes forming at least one of said first and second interengagement features integrally along a respective one of said first and second wall portions from said thin-walled material.

7. A method according to claim 1 further comprising forming a plurality of holes disposed in spaced-apart relation to one another in said lengthwise direction adjacent said first edge of said wall panel, said plurality of holes extending through at least one of said first wall portion and said first joint wall with each of said plurality of holes dimensioned to receive an associated fastener for securing said wall panel to the associated wall structure.

* * * * *